United States Patent [19]

Kwauka

[11] Patent Number: 4,615,541

[45] Date of Patent: Oct. 7, 1986

[54] BOOK COVER BLANK

[75] Inventor: Gerd-Georg Kwauka, Gütersloh, Fed. Rep. of Germany

[73] Assignee: Mohndruck Graphische Betriebe GmbH, Fed. Rep. of Germany

[21] Appl. No.: 471,356

[22] Filed: Mar. 2, 1983

[30] Foreign Application Priority Data

Feb. 1, 1983 [DE] Fed. Rep. of Germany ..... 3303196

[51] Int. Cl.[4] ..... B42D 3/00; B42C 7/00

[52] U.S. Cl. ..... 281/29; 281/34; 281/36; 412/3

[58] Field of Search ..... 281/29, 36, 34; 412/3, 412/4, 5

[56] References Cited

U.S. PATENT DOCUMENTS

| | | | |
|---|---|---|---|
| 1,602,816 | 10/1926 | Fellows | 281/23 |
| 1,995,596 | 3/1935 | Adamson | 282/29 R |
| 2,674,071 | 7/1953 | Schade | 281/29 |
| 3,169,029 | 2/1965 | Margolis | 281/29 |
| 3,231,296 | 1/1966 | Margolis | 281/29 |
| 3,314,089 | 4/1967 | Margolis et al. | 412/3 |
| 4,209,187 | 6/1980 | Forrest | 281/34 X |
| 4,301,962 | 11/1981 | Monckton et al. | 229/1.5 R X |

FOREIGN PATENT DOCUMENTS

| | | | |
|---|---|---|---|
| 0889242 | 10/1981 | Belgium . | |
| 2936674 | 11/1980 | Fed. Rep. of Germany . | |
| 3109114 | 12/1984 | Fed. Rep. of Germany . | |
| 0763462 | 5/1934 | France | 281/34 |
| 0419153 | 12/1934 | German Democratic Rep. . | |
| 1299594 | 7/1969 | German Democratic Rep. . | |
| 0728657 | 4/1955 | United Kingdom | 281/29 |

*Primary Examiner*—Robert L. Spruill
*Assistant Examiner*—Taylor J. Ross
*Attorney, Agent, or Firm*—Wigman & Cohen

[57] ABSTRACT

The invention relates to a book, comprising a book cover blank and an inner book having a spine. The book cover blank is preferably formed in one piece, includes two inner cover portions, two outer cover portions, at least one spine member, and a spine portion. The inner cover portions are glued to the outer cover portions. At least one spine member is arranged on the inside over the spine portion without any bond thereto. The spine member is connected in one piece with the cover blank and is attached to the spine of the inner book.

19 Claims, 10 Drawing Figures

FIG. 3
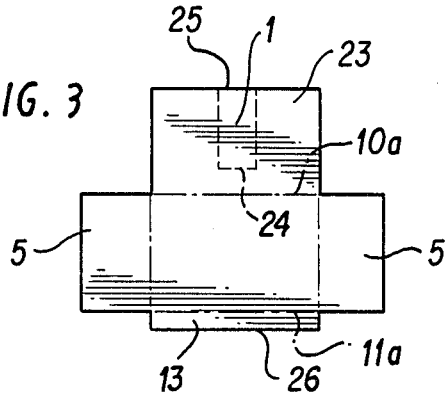
FIG. 4
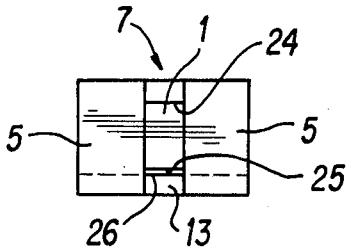
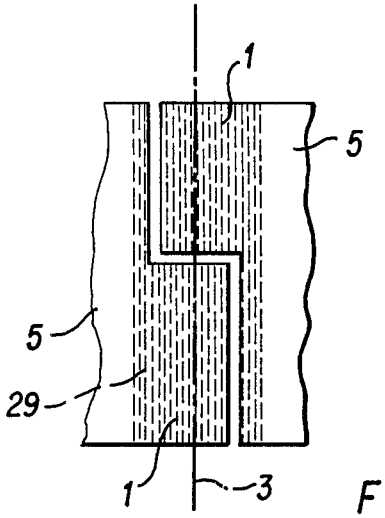
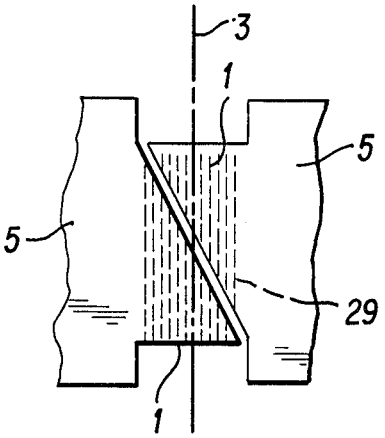
FIG. 5
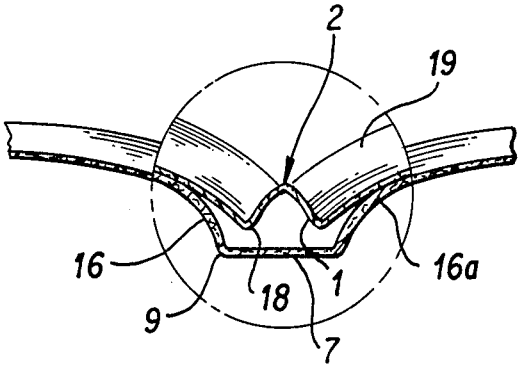
FIG. 7
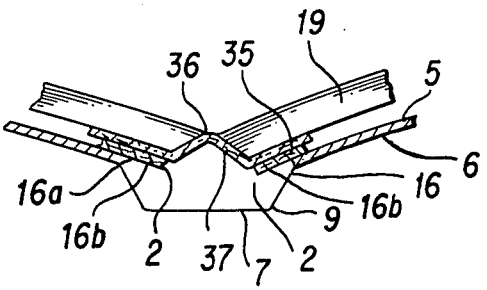
FIG. 8

BOOK COVER BLANK

BACKGROUND OF THE INVENTION

1. Field of the Invention

The invention relates to a book.

2. Description of the Prior Art

In West German Patent Application No. P 31 09 114, a book is proposed which is comprised of a relatively soft book cover and an inner book, whereby the book cover can be formed as a one-piece cover blank and includes two inner cover portions, two outer cover portions and a spine portion. The inner cover portions and the spine portion are separated from respective outer cover portions by grooves. A preferably continuous stiffening member is attached to the top cut edge and the bottom cut edge of the outer cover portion, as well as to the corresponding edge of the spine portion, whereby grooves are provided in the top cut and the bottom cut edges.

An additional relevant book cover is disclosed in West German Pat. No. 1 299 594. The insertion of the inner book into the known book cover is done in a manner such that the fly-leaves or corresponding end pages of the inner book are attached exclusively to the surfaces of the inner cover portions, primarily near the folding areas. This manner of attachment provides no connection between the back of the inner book and the book cover so that the bound book is similar to a conventional book in the spine area, and yet the bond is not sufficiently strong so that after the book is opened many times, the bond between the book cover and the inner book tears or becomes separated.

In connection with a binding having a soft cover in which the inner book is usually glued over the full surface of the spine and sometimes also in the folding area, it is known from West German Patent Application No. 29 36 674 to avoid using the spine of the relatively soft cover for binding the inner book in order to avoid spine insertion and the disadvantages associated therewith. Instead, a gauze strip is glued to and around the spine of the inner book, and the front and back cover pages of the soft cover are glued only to a lateral attachment edge of the gauze strip, so that, when the book is opened, the spine portion of the book cover can lift away from the back of the inner book, as is common with a book having a rigid cover. With so-called soft cover books, however, even this known manner of attachment is not sufficient.

In this connection, West German Patent Application No. P 31 09 114 provides the arrangement of a strip, preferably a folding strip, the edge portion of which overlaps the spine portion of the book cover, and only this overlapping edge portion is glued to the inside surface of the respective outer cover portion and/or inner cover portion next to the groove separating the spine portion from the side portions of the book cover.

SUMMARY OF THE INVENTION

In the manufacture of the proposed book cover, the inner portions of the covers are glued to the respective inner surfaces of the outside portions, after the stiffening members have been previously glued to the inner surfaces of the outer cover portions and, in some cases, of the spine portion. As proposed, it can be provided that the free inner cover edge overlaps at least a portion of the attachment edge of the folding strip. This proposed embodiment, which is manufactured from a one-piece blank, makes it possible to glue the inner book, by means of the fly leaves, as usual, with the spine on the folding strips and portions thereof also on the inner cover portions. Since the folding strip is not connected with the spine portion of the book cover, the glue-bound book opens like a normal book with a hard cover.

The object of the invention is, with relatively soft, multiple-layer covers preferably manufactured from a one-piece blank, to simplify the manufacturing process by gluing the inner book back basically over its full surface, without the spine portion of the book cover being incorporated into the gluing.

BRIEF DESCRIPTION OF THE DRAWINGS

With the aid of the embodiments shown in the drawings, the invention will now be described in greater detail. Shown are:

FIG. 3 is a top view of another embodiment of a book cover blank according to the invention;

FIG. 4 is a top view of the book cover manufactured from the blank according to FIG. 3;

FIG. 5 shows schematic embodiments of the free longitudinal end edges of the spine stiffener of the book cover blank according to FIG. 1;

FIG. 7 shows a schematic of a cross-section through special embodiment of the spine gluing with an enlarged illustration of the spine region in the circle;

FIG. 8 is a schematic cross-section through another embodiment of the spine gluing;

DETAILED DESCRIPTION OF THE PREFERRED EMBODIMENTS

Figure 1:
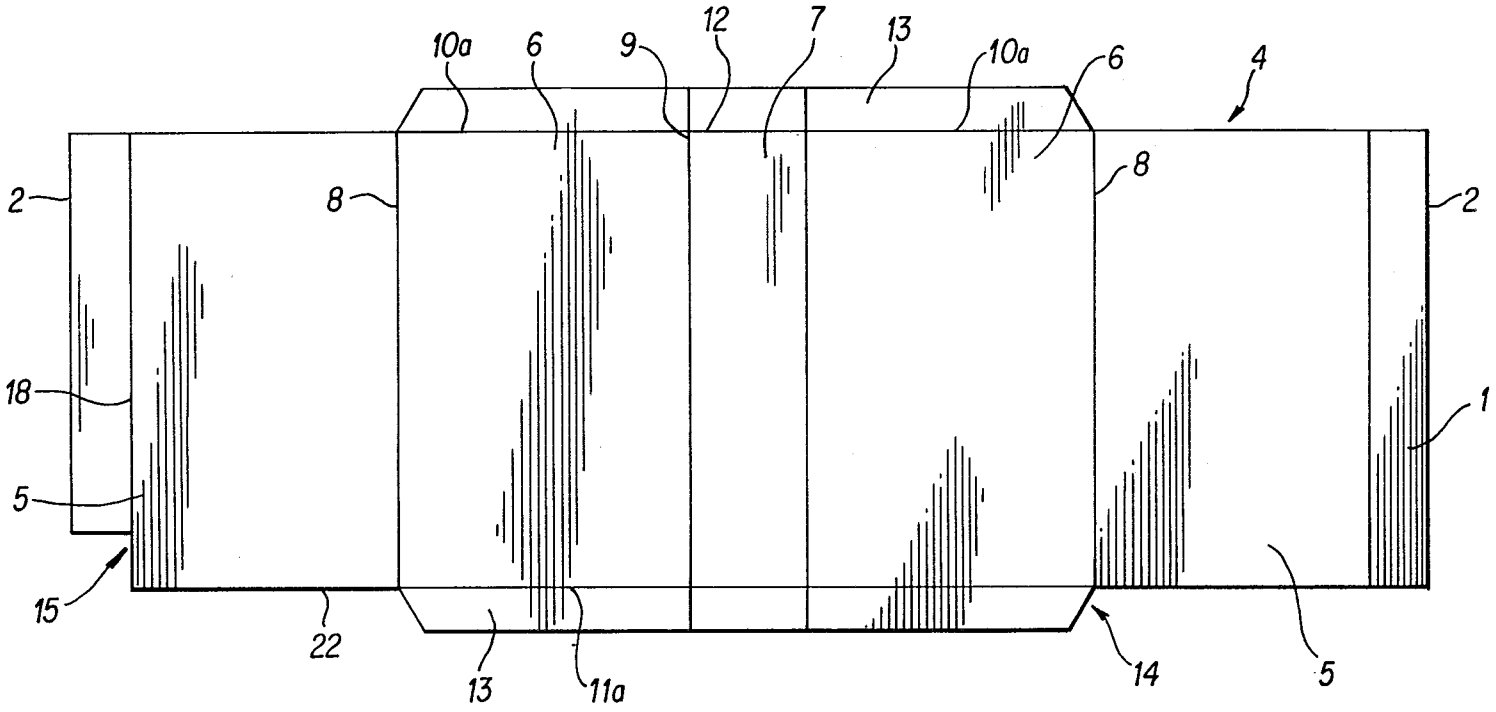
FIG. 1 is a top view of a book cover blank according to the invention.

The new book cover can be made from a web of binding material, which is comprised of layers of exterior material, glue, and preferably flexible pasteboard, plastic or the like, whereby the pasteboard is glued over its entire surface, without gaps, to the exterior material. A cover blank 4 (FIG. 1) is then cut or stamped out from the binding material web, which can also consist of a single-layer material. The blank 4 is formed in one piece and includes two inner cover portions 5, two outer cover portions 6 and a spine portion 7. Each inner cover portion 5 is separated from the outer cover portion 6 by a groove 8. In place of the groove 8, it is also possible to use a cut-through pasteboard or a perforation or the like. The separation of the spine portion 7 from the respective outer cover portions 6 is achieved by a groove 9. A cut or perforation or the like can also be provided in this instance. It is preferred that a continuous stiffening member 13 is bound to the top cut edge 10 shown in FIG. 2 and to the bottom cut edge 11 also shown in FIG. 2 of the outer cover portion 6 in FIG. 1 as well as to the spine edge 12. It is advisable to chamfer the ends of these continuous stiffening members 13, which are separated from the binding locations by grooves 10*a* and 11*a*.

The book cover made from this type of blank by gluing the respective inner cover portions 5 to the inner surfaces of the outer cover portions 6 in that the cover portions 5 are folded along the groove 8.

Figure 2:
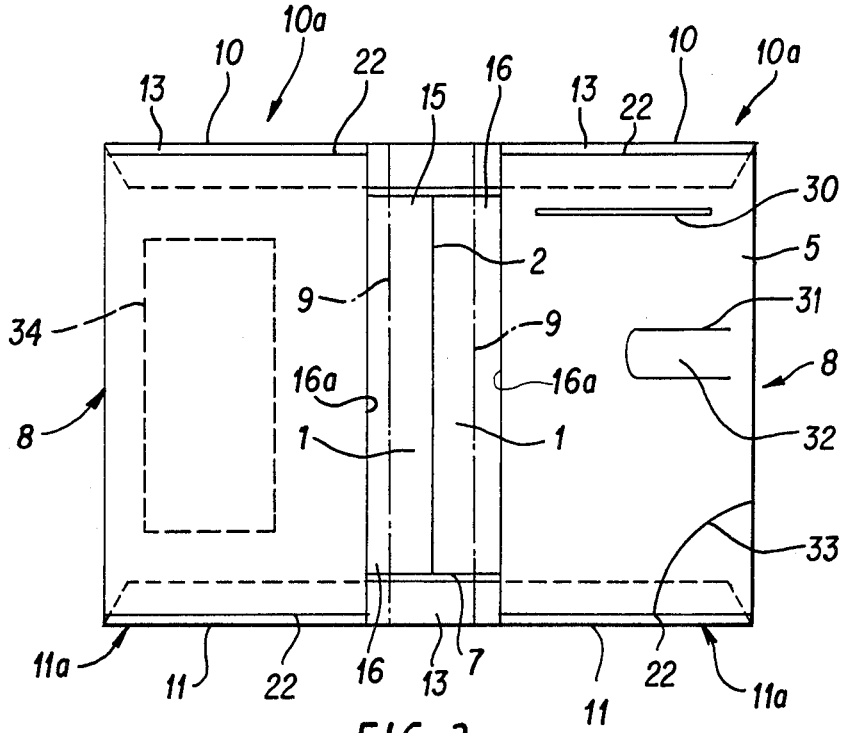
FIG. 2 is a top view of the book cover manufactured from the blank according to FIG. 1.

It is preferable to fold the stiffening members 13 before the inner cover portion 5 is glued in place, so that advantageous outwardly rounded edges 10 and 11 result as shown in FIG. 2. The stiffening members 13 are glued to the inner surfaces of the outer cover portions 6 shown in FIG. 1 and the spine portion 7, so that the inner cover portions 5, after they are glued in place in the top and bottom cut areas, lap over the stiffening members 13. It can also be advantageous to provide longer stiffening members 13, so that they extend preferably into the center of the outer cover portions 6, thus achieving a particularly strong reinforcement of the book cover, so that relatively stiff book covers can be produced even with the use of a very thin pasteboard.

For normal quality requirements, the described book cover is completely sufficient. The strength of the book cover with an equal sized blank can be influenced by the selection of the pasteboard stiffness and quality. The selection of the glue can also raise or lower the stiffness of the book cover, so that sufficient possibilities for variations are available to achieve certain desired cover qualities.

Furthermore, with the same binding material, the strength and stiffness as well as the quality of the book cover can be influenced by the blank itself. For example, as described above, the stiffening members 13 can be made longer or can be eliminated entirely. It is also possible to widen the inner cover portion 5 by the same amount and to produce a multiple-layered inner cover portion 5 by zig-zag folding (not shown). However, the same stiffening effect can also be achieved by additionally or alternatively connecting stiffening members 13 to the top and bottom cut edges 10 and 11 shown in FIG. 2 of the inner cover portion 5 and gluing them to the inner surface of the inner cover portion 5.

Expensive automatic book cover machines and the trimming of individual portions of the book cover can be eliminated in the manufacture of the new book covers. The binding material of which the new book cover can be made can be used as an endless web, whereby the blank and the gluing of the blank can be handled, for example, in conventional box folding machines or record disc packaging machines or cartoning machines or the like. These types of machines operate at a very high capacity. For example, they can be arranged in front of a glue binder, so that the finished covers can be fed to the inner books in the glue binder or immediately thereafter, and the placement of the inner book in the cover, for example as with brochures, can be performed in the glue binder. The need for a placement machine is thus eliminated.

Figure 6:
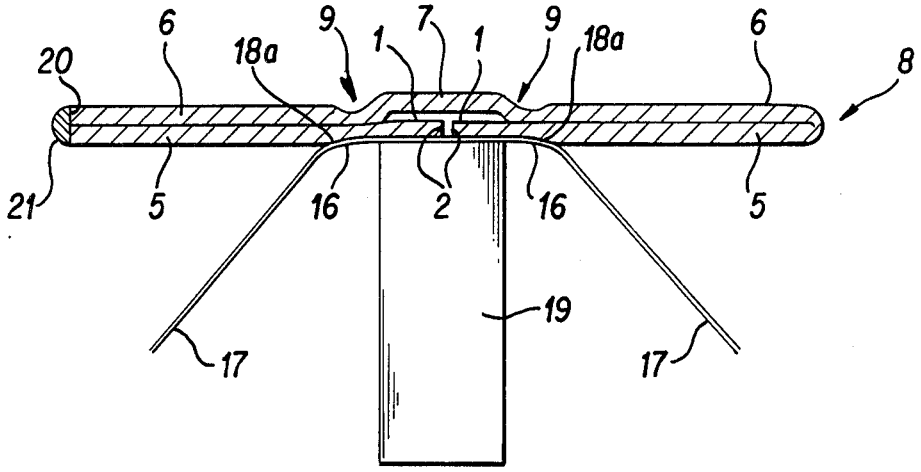
FIG. 6 is a schematic cross-section through a book according to the invention.

The finished book is illustrated in FIG. 6. The inner book 19 is glued to the spine via the fly-leaves 17 and the spine members 1 and is also glued to a part of the inner cover portion 5 at area 18*a*. Of course, a different gluing can also be provided with or without the fly leaves (not shown).

The embodiment of the invention according to FIG. 6 shows that the new book cover can be printed on both inside and outside without problems and that the printing can be performed during the cover manufacture or previously during the manufacture of the binding material or prior to the manufacture of the binding material. For example, this might be a primer for the content statement on the inside of the wrapper (inner surface of the inner cover portion 5).

According to an additional embodiment of the invention, the edges 20 of the new book cover can be trimmed in the area of the front edge and finished with an applied plastic edge 21 (FIG. 6, left side). It is advantageous to provide this type of edge finishing on the top and bottom cut edges 10 and 11 of the new cover as well (shown in FIG. 2).

It is advantageous if the edges 22 of the inner cover portion 5 recede relative to the grooves 10*a* and 11*a*, so that the inner cover portion 5 is narrower than the outer cover portion 6, which is shown in FIG. 1 and particularly in FIG. 2. This embodiment results in perfectly rounded outer edges 22 at the grooves 10*a* and 11*a*, because the edges 22 do not extend to the respective outer edges. Preferably, the areas of the inner cover portion 5, which overlap the stiffening members 13, are pressed or squeezed into the cover in a known manner, so that these areas do not project above the surface, but rather are approximately equally as thick as the other areas of the cover. For the same reason, however, the edges 22, as is also known, can be similarly handled (not shown).

According to the invention, it is provided that respective spine members 1 are connected as lateral extensions of the edges or grooves 18 shown in FIG. 1 of the inner cover portion 5, the width of which spine members 1 preferably corresponds at a maximum to half the width of the spine portion 7. After the manufacture of the book cover from the blank according to FIG. 1, the free longitudinal end edges 2 lie opposite the spine members 1 (FIG. 2).

Significant to the invention is that the spine members 1 are not glued to the spine portion 7, but rather are arranged in free contact therewith and that the inner book back (unnumbered) is glued to the spine members 1, as shown in FIG. 6.

The free longitudinal end edges 2 of the spine members 1 can abut each other (FIG. 2) or be arranged at a distance from each other (not shown). In this case, the width of at least one spine member 1 is less than half the width of the spine member 7. The edges 2 do not have to run straight. They may effectively take the shapes according to FIG. 5 or similar shapes, so that corresponding areas of the spine members 1 are arranged mirror-image symmetrically to each other and the longitudinal center line 3 of the spine portion 7 projects onto respective opposite sides. It can also be advantageously provided that the spine members 1 are provided with longitudinal channels or grooves or the like described hereinafter. The two described measures improve the flexibility of the back area of the inner book placed in the cover when the book is opened.

Figure 10:
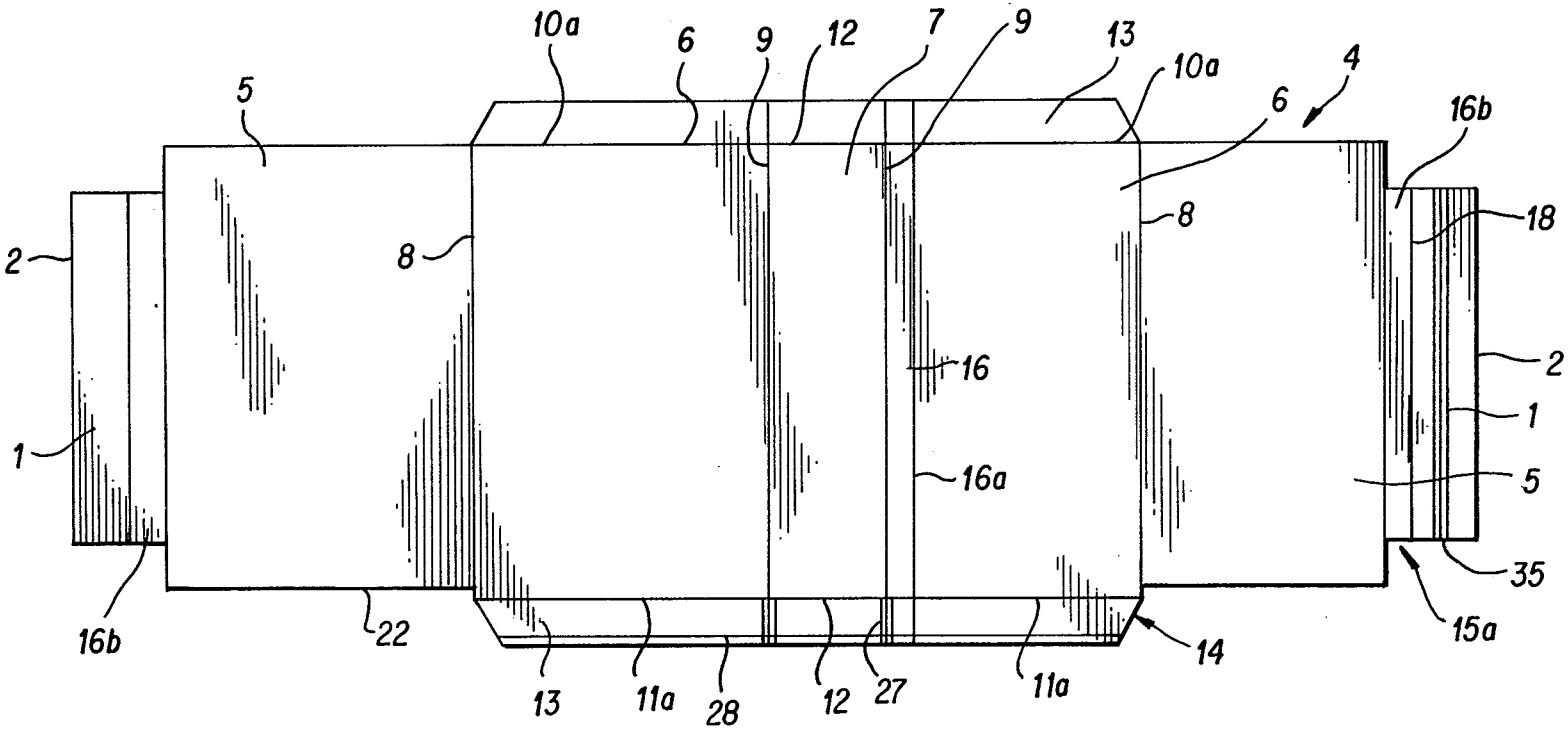
FIG. 10 is a top view of a book cover blank showing additional embodiments of the invention.

Preferably, as shown in FIG. 1, an angled corner 15 is cut off so that the corresponding edge of the spine member 1 remains inwardly displaced and out of sight after the book is bound. In a case where a book fold 16 is provided for the previously mentioned reason, a corner 15*a* recedes to a fold groove 16*a* (FIG. 10). This embodiment is illustrated in FIG. 2.

According to an additional embodiment of the invention according to FIGS. 3 and 4, a spine member 1 arranged freely over the spine portion 7 is achieved in that a strap 23 is connected to the grooves 10*a* or 11*a*, which strap 23 can selectively extend over the entire width of the blank (not shown). In FIGS. 3 and 4, the portions designated 6, 7, 9, 16 and others in FIGS. 1 and 2, and 10 are not shown, in order not to disrupt the clarity of the drawings.

It is significant that the spine member 1 is formed by a cut slit 24 or cut-out which is located in the strap 23 parallel to the grooves 10*a* and 11*a*. The length of the cut slit 24 corresponds to the width of the spine portion 7 or the width of the spine portion 7 plus the respective width of the fold 16. When the strap 23 is glued to the outer cover portion 6 and spine portion 7, the spine member 1 is excluded therefrom. Instead, the back of the inner book 19 is glued to the spine member 1. The height of the strap 23 corresponds to the height of the portions 6 and 7 between the edges 10 and 11 in FIGS. 1 and 2, or as shown in FIGS. 3 and 4, it may be shorter. The cut slit 24 may also be located in the groove 10*a* or 11*a*. Preferably, the cut slit 24 is arranged at a distance from the groove 10*a* or 11*a* which distance corresponds to the width of the member 13 and the height of the strap is selected such that an edge 25 of the spine member 1 lies directly opposite an edge 26 of the stiffening member 13 (FIGS. 3 and 4). In the case of FIGS. 3 and 4, success is achieved with a surprisingly simple means, namely, the arrangement of a cut slit 24, in forming a spine member 1, which, according to the invention, has no connection with the spine portion 7 and yet is glued to the back of the inner book 19.

Within the framework of this inventive concept, one can also provide respective straps 23 connected both to the groove 10*a* as well as to the groove 11*a*, the heights of which complete the distance between the edges 10 and 11 shown in FIGS. 1 and 2. Preferably, the straps 23 in this case are equally long and meet at the half-way point of the spine length, whereby a cut slit 24 is also arranged in the other strap 23 or in the other groove 11. Equally as effective as in the embodiment according to FIGS. 1 and 2, the spine member 1 in the embodiment according to FIGS. 3 and 4 can be channeled or grooved parallel to the grooves 9 of FIGS. 1 and 2.

The invention succeeds in significantly simplifying the work and shortening the time involved in book manufacturing, which success is achieved by means of the fact that the placement can take place in the glue binder. It is preferably also possible to make the finish cut of the compiled layers of the inner book prior to the spine gluing, advantageously prior to the transfer into the inner book holder of the glue binder, whereby the cut product is advantageously also fixed in position, which fixation can take place by vibration in the glue binder prior to the transfer into the inner book holder. It is advantageous thereby for the compiled product to be provided with a stamped perforation in the back prior to the cutting or trimming to assist in fixing the positions, and for an adhesive, preferably hot-melt, to be introduced into the stamped perforation. For purposes of position-fixing, however, the compiled products can also be notched in the back and the notches can be filled with adhesive, preferably hot-melt.

In the case of the embodiment according to FIGS. 3 and 4, it is also possible to provide a rectangular cut-out in place of a cut slit 24, the length of which cut-out corresponds to the length of cut slit 24 and the width of which corresponds preferably to the width of the stiffening member 13. This embodiment is chosen when no stiffening member 13 is to be present in the spine area. This embodiment is particularly advantageous when straps 23 are connected both to the groove 10*a* and to the groove 11*a*.

According to a special embodiment of the invention shown in FIG. 2, it is provided that the book cover blank has fold grooves 16*a* on both sides of the grooves 9 so that respective book folds 16 result. Accordingly, the spine members 1 are made longer by the amount of the width of book fold strip 16*b*, as shown in FIG. 10. The gluing in this case is performed in such a manner that, adjacent to the spine member 1, a book fold strip 16*b* is also not glued to the book fold strip 16 adjacent to the groove 9. By this means, spine 7 is free to hinge outwardly because of the grooves 9 and 16*a* (see FIG. 7) when the book is opened.

In order to facilitate the folding of the stiffening member 13, and particularly to insure that the stiffening members 13 do not separate from the areas of the grooves 9 and/or 16*a* before or after the gluing and especially during a bending of the book cover, additional outwardly pressed grooves 27 are provided in the area of the stiffening members 13 adjacent to the grooves 9 and 16*a*. The length of these additional grooves 27 corresponds to the width of the stiffening member 13 (FIG. 10). It has surprisingly been shown that, by means of this type of simple grooves, the above-mentioned problems can be solved, which, according to the prior art, were solved by wedge-shaped cut-outs (See West German Pat. No. 12 99 594, FIG. 1, element 13).

It is advantageous that the outer edge area 28 of the stiffening members 13 be compressed thinner preventing edge area 28 from pressing up from underneath in the finished book cover, i.e., it is not recognizable on the visible surface of the inner cover portion Compressed edge area 28, shown in FIG. 10, should, to be effective, extend over the entire length of the stiffening member 13.

A further embodiment of the invention shown in FIG. 10 provides the spine members 1 with longitudinal channels or grooves 35 in order to achieve an improved flexibility in the back area of the inner book placed in the cover when the book is opened. It is still better, however, to provide the spine members 1 with longitudinally extending perforations 29, as shown in FIG. 5. These perforations 29 effect not only an improvement in the flexibility of the back area of the inner book 19 placed in the cover when the book is opened, but also provide an improved glue bonding with the back of the inner book 19 because glue can penetrate into the perforations 29 and thereby become anchored (FIG. 5). It is effective to arrange additional perforations 29 in the area next to the spine members 1 which arrangement results in a particularly good bonding of the cover to the inner book 19. The perforations 29 preferably extend over the entire area of book fold strip 16*b* and spine member 1 (compare the left side of FIG. 5 with FIG. 1).

A further embodiment of the invention provides a gluing of the inner cover portion 5 only along the edges (not shown). This variation creates the possibility of providing cuts and/or perforations in the inner cover portion 5 (FIG. 2). For example, a cut 30 running parallel to the edge 22 results in an insertion pocket. A U-shaped cut 31, the connection of which remains in the vicinity of the groove 8, produces a strap 32, which can serve, for example, as a bookmark. An arc-shaped cut 33 in the lower outside corner of the inner cover portion 5 results in an approximately triangular pocket which can serve to hold enclosures.

Perforated part 34 can be, for example, a postcard. Accordingly, according to the invention, the inner cover portions 5 can serve additional purposes.

The embodiment according to FIG. 8 of the invention includes book fold strips 16*b*, the width of which correspond preferably to the width of book fold 16. Accordingly, the free longitudinal end edges 2 of the book fold strips 16*b* are spaced from each other. This spacing distance preferably corresponds to the width of the entire inner book 19.

The book fold strips 16*b* are glued to the side areas of the inner book 19 by means of a first glue layer 35, but are not glued to the back of the inner book 19. The book fold strips 16*b* are also not glued to the corresponding book fold 16. The first glue layer 35 can be applied wider than the width of the book fold strip 16*b*, so that part of the inner cover portion 5 is glued to a side area of the inner book 19. It is preferred for a folding band 37 to be glued to the back of the inner book 19 by a second glue layer 36, which folding band 37 also extends onto the side areas of the inner book 19, to which it is also glued. Preferably, the folding band 37 extends onto the side areas of the inner book 19 by an amount corresponding to the width of the book fold strips 16*b*, so that the book fold strips 16*b* are glued to the folding band 37. This variation of the invention effects a particularly easy opening of the book. It is effective for the book fold strips 16*b* to include longitudinal grooves or channels, but preferably perforations (not shown), which produce a further improvement in flexibility and, in the case of the perforations, assure an improvement in the gluing.

Figure 9:
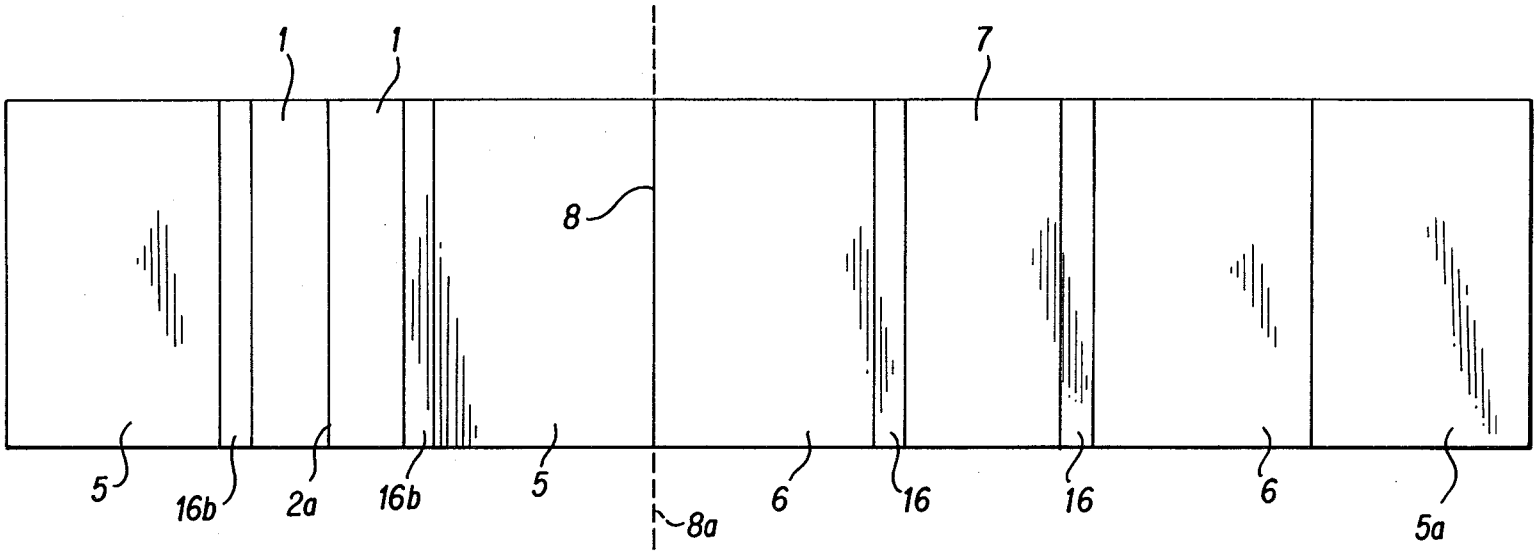
FIG. 9 is an additional schematic top view of the book cover blank according to the invention.

A special embodiment of the invention permits the stiffening member 13 to be eliminated. This additional embodiment of the invention relates to a book having a book cover made from a blank according to FIG. 9. In this embodiment, the spine members 1 are connected.

Preferably, an additional inner cover portion 5*a* is connected to the right side of the outer cover portion 6. The book cover is folded along the groove 8*a*, so that the spine member 1 is disposed above the spine portion 7. Except for the spine portion 7, the inner cover portions 5 are glued together, and then, according to the preferred embodiment, the additional inner cover portion 5*a* is glued to the left outside of the inner cover portion 5 after folding. Of course, it is also possible to provide the same connection on the right side instead of the left side.

The suspension of the inner book 19 takes place in this embodiment of the invention by gluing spine portion 1 and/or the book fold strips 16*b* to the back of the inner book 19, so that the spine portion 7 and the book fold 16 have no connection with the inner book 19.

The spine portion 1, for purposes of the invention, is separated by a scoring or groove 2*a*, so that these portions in the glued condition of the inner book 19 can be bent around the scoring or groove 2*a* when the book is opened. It is preferable for a number of this type of scoring or groove to be provided in the area of the spine portion 1.

These embodiments of the present invention are considered to be illustrative only since other modifications will be readily discerned by those skilled in the art of book making. In any event, the scope of the invention is intended to be covered by both the letter and the spirit of the claims made hereinafter.

I claim:

1. A book comprising:

a book cover blank;

an inner book having a back;

said book cover blank being formed in one piece and including two inner cover portions, two outer cover portions, two spine members, and a spine portion, said book cover blank further being formed so that one end of each spine member is integrally connected with one end of one of the inner cover portions and the other end of each spine member is a free longitudinal edge;

said inner cover portions being glued to the outer cover portions;

said spine members being arranged on the inside over the spine portion of the book cover blank with no bond thereto; and said spine members are arranged so that the free longitudinal edges are adjacent one another and the spine members are attached to the back of the inner book.

2. The book of claim 1 wherein the free longitudinal edges of the spine members are spaced apart from each other.

3. The book of claim 1 in which the free longitudinal edges of the spine members are displaced with respect to each other so as to project beyond the mid-longitudinal line of the spine portion and form corresponding regions of the respective spine members, wherein the corresponding regions of the respective spine members lie in mirror-image symmetry with respect to each other.

4. The book of claim 1 wherein said book cover blank is further formed to include:

a first pair of book fold strips, each of said first book fold strips being arranged between an inner cover portion and the spine with which the inner cover portion is connected; and a second pair of book fold strips, each of said second book fold strips being arranged between one of the outer cover portions and the spine portion.

5. The book of claim 1 wherein each of said spine members are provided with angled recesses at either edge whereby the edges of said spine members are displaced inwardly with respect to the edges of the inner cover portions.

6. The book of claim 1 wherein the spine members are provided with means for improving the flexibility of the back of the inner book when said book is opened.

7. The book of claim 6 wherein said means for improving the flexibility of the back of the inner book are one of a plurality of grooves and a plurality of recesses.

8. The book of claim 1 wherein the inner cover portions are glued to the outer cover portions only at their edges and one of a cut and a perforation is made in one of the inner cover portions.

9. The book of claim 8 wherein a cut is made in one of the inner cover portions, said cut running parallel to an edge of the inner cover portion.

10. The book of claim 8 wherein an end of each of the inner cover portions is integrally connected with an end of one of the outer cover portions and a groove is provided separating each of the inner cover portions from its respective outer cover portion, and a U-shaped cut is made in one of the inner cover portions adjacent the groove separating the inner cover portion from the respective outer cover portion.

11. The book of claim 8 wherein an arc-shaped cut is made in one corner of one of the inner cover portions.

12. The book of claim 8 wherein a rectangular-shaped perforation is made in one of the inner cover portions.

13. The book of claim 1 wherein each end of the spine portion is integrally connected with one end of one of the outer cover portions, each end of the spine portion is separated from the end of the respective outer cover portion by a groove, and each end of each of the spine members is separated from the end of the respective inner cover portion by a groove.

14. The book of claim 13, wherein a top cut edge is formed by the top edge of the integral connection of the two outer cover portions and the spine portion and a bottom cut edge is formed by the bottom edge of the integral connection of the two outer cover portions and the spine portion, and wherein a continuous stiffening strap is provided at each of the top and bottom cut edges, and a groove is provided at each of the top and bottom cut edges.

15. The book of claim 14 wherein the stiffening straps are glued to the insides of the outer cover portions and the spine portion.

16. The book of claim 14 wherein the book cover formed by the book cover blank has edges and wherein said book cover edges are trimmed and coated with a plastic edging.

17. The book of claim 14 wherein the edges of inner cover portions are recessed with respect to the grooves provided at the top and bottom cut edges.

18. The book of claim 14 wherein the grooves separating the spine portion and the outer cover portions extend across the top and bottom cut edges along the entire width of the stiffening strap and a plurality of grooves are provided in the stiffening members adjacent to and parallel with the extension of each of the grooves separating the spine portion and the outer cover portions, said plurality of grooves provided in the stiffening members being pressed outwardly and having a length corresponding to the width of the stiffening straps.

19. The book of claim 18 wherein the outer edges of the stiffening straps are compressed to a reduced thickness.

* * * * *

UNITED STATES PATENT AND TRADEMARK OFFICE

CERTIFICATE OF CORRECTION

PATENT NO. : 4,615,541

DATED : October 7, 1986

INVENTOR(S) : GERD-GEORG KWAUKA

It is certified that error appears in the above-identified patent and that said Letters Patent is hereby corrected as shown below:

Claim 4, column 8, line 36, after "spine", insert --member--.

Signed and Sealed this

Sixteenth Day of December, 1986

*Attest:*

DONALD J. QUIGG

*Attesting Officer* *Commissioner of Patents and Trademarks*